US007458196B2

(12) United States Patent
Federici et al.

(10) Patent No.: US 7,458,196 B2
(45) Date of Patent: Dec. 2, 2008

(54) METHOD AND MACHINE FOR PACKING ARTICLES

(75) Inventors: Luca Federici, Bologna (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 11/732,517

(22) Filed: Apr. 3, 2007

(65) Prior Publication Data

US 2007/0261372 A1 Nov. 15, 2007

(30) Foreign Application Priority Data

Apr. 4, 2006 (IT) ..... BO06A0237

(51) Int. Cl.
*B65B 11/58* (2006.01)
*B65B 35/50* (2006.01)
*B65B 11/28* (2006.01)

(52) U.S. Cl. ..... 53/449; 53/410; 53/447; 53/234; 53/286; 53/378.3

(58) Field of Classification Search ..... 53/410, 53/416, 444, 447, 449, 154, 152, 234, 286, 53/377.8, 378.3
See application file for complete search history.

(56) References Cited

U.S. PATENT DOCUMENTS 4,617,780 A * 10/1986 Focke et al. ..... 53/466
4,909,019 A * 3/1990 Delacretaz et al. ..... 53/463
5,305,580 A * 4/1994 Draghetti ..... 53/465
5,406,775 A * 4/1995 Tacchi et al. ..... 53/466
5,461,842 A * 10/1995 Brizzi et al. ..... 53/234
5,477,661 A * 12/1995 Draghetti et al. ..... 53/466
6,035,612 A * 3/2000 Draghetti et al. ..... 53/466
6,138,437 A * 10/2000 Focke et al. ..... 53/133.7
6,516,589 B1 * 2/2003 Draghetti et al. ..... 53/466
6,675,556 B2 * 1/2004 Bertuzzi et al. ..... 53/234
6,698,158 B2 * 3/2004 Spatafora ..... 53/77
7,200,978 B1 * 4/2007 Focke et al. ..... 53/441

FOREIGN PATENT DOCUMENTS

| | | |
|---|---|---|
| EP | 0 893 349 | 1/1999 |
| EP | 0 940 339 | 9/1999 |
| WO | 2005/105625 | 11/2005 |

OTHER PUBLICATIONS

English Abstract of EP 0 893 349 dated Jan. 27, 1999.

* cited by examiner

*Primary Examiner*—Paul R Durand
(74) *Attorney, Agent, or Firm*—Ladas & Parry LLP

(57) ABSTRACT

A method and machine for packing packets, whereby, as two packets are fed singly and successively along a path from an input station to an output station, respective sheets of packing material are folded about the two packets to form respective wrappings; the two packets, enclosed in the respective wrappings, are brought into contact with each other to form a group of packets, and are again fed from the input station to the output station, while a further sheet of packing material is folded about the group of packets.

12 Claims, 2 Drawing Sheets

METHOD AND MACHINE FOR PACKING ARTICLES

The present invention relates to a method and machine for packing articles.

The present invention may be used to advantage for packing cigarettes, to which the following description refers purely by way of example.

More specifically, the present invention relates to a machine for packing articles, comprising a first conveying device for feeding at least two articles singly and successively along a first path from an input station to an output station; a folding device for folding a respective sheet of packing material about each article to form a respective first wrapping about each article; and a group-forming device for bringing the articles into contact with each other to form a group of articles.

BACKGROUND OF THE INVENTION

Known machines of the type described above normally comprise a further folding device to form a further wrapping about the group of articles and so obtain packages containing two or more articles.

Known machines of the type described above are relatively bulky and expensive, by normally requiring a number of conveyors and folding devices, normally arranged in series.

SUMMARY OF THE INVENTION

It is an object of the present invention to provide a method and machine designed to at least partly eliminate the aforementioned drawbacks, and which, at the same time, are cheap and easy to implement.

According to the present invention, there are provided a machine and method for packing articles, as claimed in the attached Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
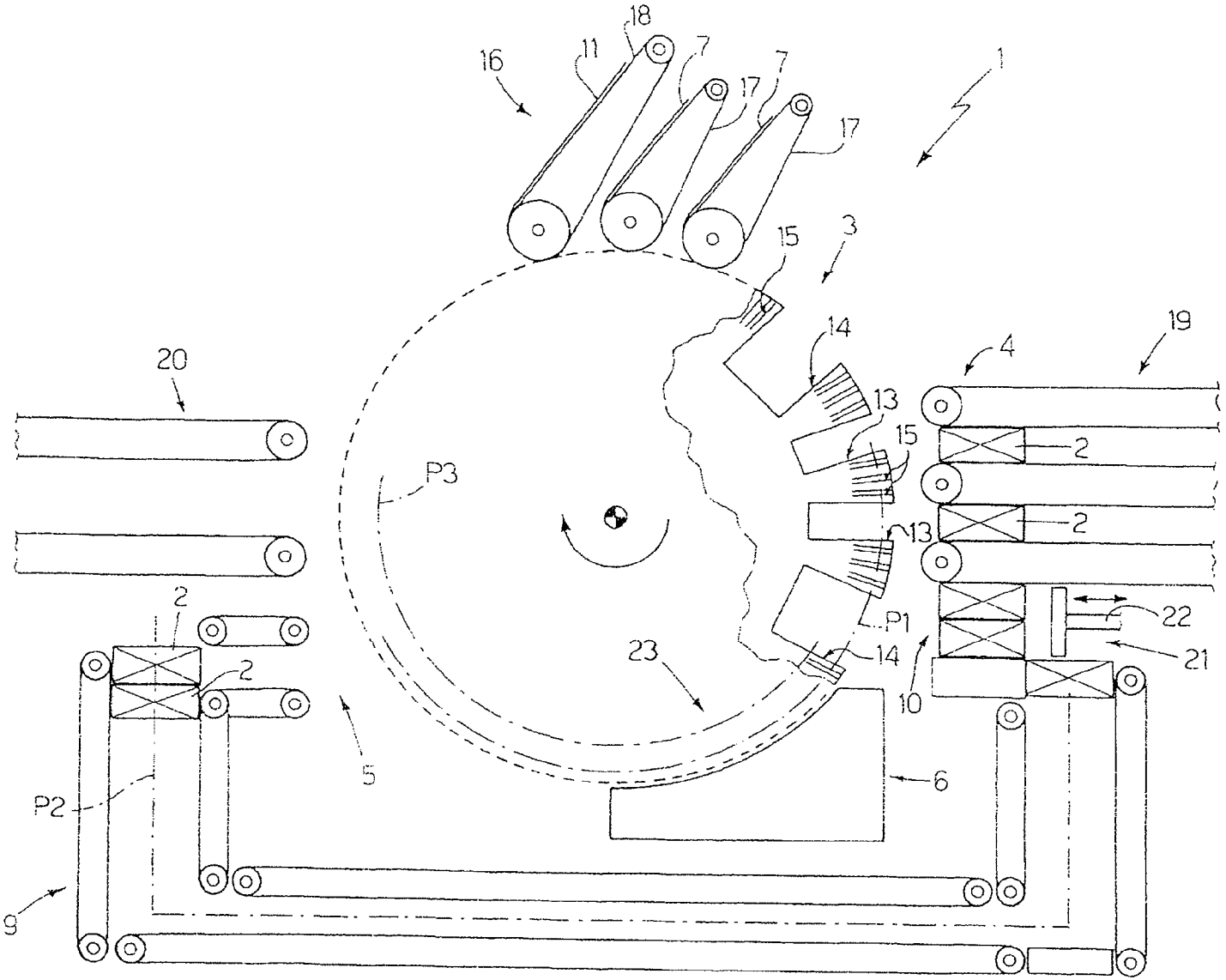
FIG. 1 shows a schematic, partial front view of a machine in accordance with the present invention.
Figure 2:
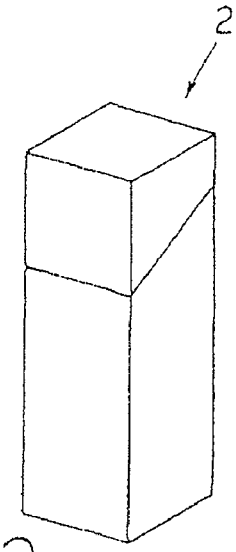
FIG. 2 shows an article that can be packed on the FIG. 1 machine.
Figure 3:
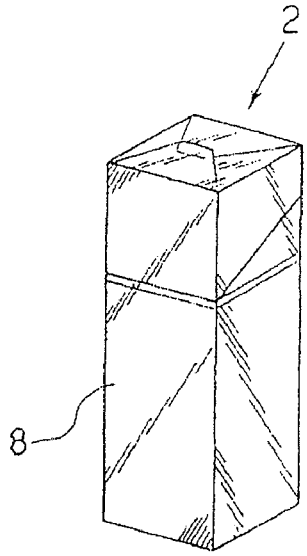
FIG. 3 shows the FIG. 2 article packed.

Number 1 in FIG. 1 indicates as a whole a machine for packing articles 2 in the tobacco industry. Machine 1 comprises a conveyor wheel 3 for feeding two articles 2 singly and successively, at each operating cycle, along a path P1 from an input station 4 to an output station 5; and a folding device 6 (shown schematically) for folding a respective sheet of packing material 7 about each article 2 to form a respective wrapping 8 (FIGS. 2 and 3) about each article 2.

Machine 1 also comprises a conveying device 9 (shown schematically in FIG. 1) for conveying articles 2, enclosed in respective wrappings 8, along a path P2 from output station 5 to input station 4; which conveying device 9 comprises a number of belt conveyors.

Figure 4:
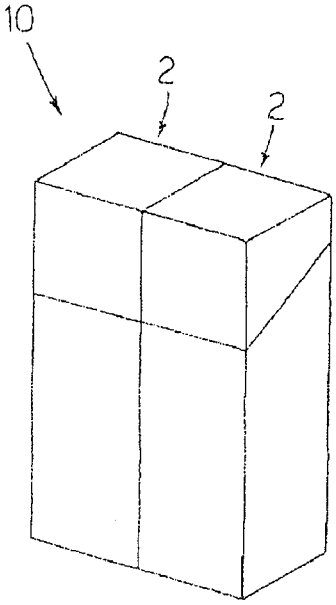
FIG. 4 shows a group of FIG. 3 articles.
Figure 5:
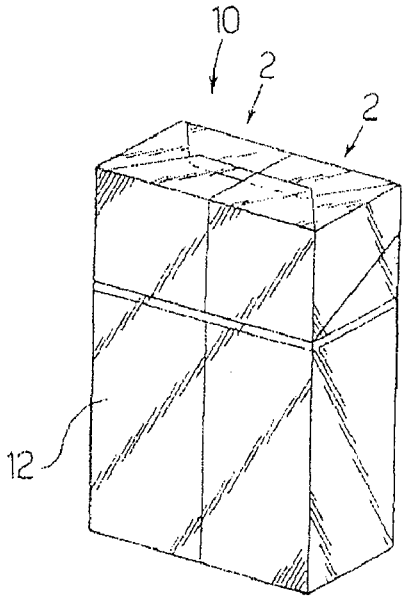
FIG. 5 shows the FIG. 4 group packed.

In actual use, at each operating cycle, two articles 2, enclosed in respective wrappings 8, are brought into contact with each other to form a group 10 of articles 2, and are fed from input station 4 to output station 5 along a path P3 partly coinciding with path P1, while folding device 6 folds a sheet of packing material 11 about group 10 to form a wrapping 12 (FIGS. 4 and 5) about group 10.

Conveyor wheel 3 comprises a number of seats 13 (FIG. 1), each for receiving and housing a respective article 2 in a manner not shown in FIG. 1 but obvious to a skilled technician; and a number of seats 14, substantially twice the size of seats 13, and each for receiving and housing a respective group 10. More specifically, seats 13 and 14 are arranged so that two side by side seats 13 (i.e. with no seat 14 in between) are followed by a seat 14.

It should be pointed out that, in different embodiments, group 10 may comprise more than two articles 2; in which case, the number of side by side seats 13 equals the number of articles in each group. Generally speaking, the ratio between the total number of seats 13 and the total number of seats 14 equals the number of articles 2 in each group 10.

Conveyor wheel 3 also comprises a number of suction nozzles 15 connected to a known suction source (not shown) to receive and hold in position the sheets of packing material 7 and 11 supplied by a feed assembly 16 (shown partly in FIG. 1).

In the embodiment shown, seats 13 and 14 are fixed with respect to one another; in further embodiments, seats 13 and 14 are movable. In which case, conveyor wheel 3 may, for example, be of the type described and/or illustrated in EP-A1-940339, EP-A1-936143, U.S. Pat. No. 6,708,466 and/or WO-A1-2005/105625, to which full reference is made herein for the sake of clarity.

In further embodiments, conveyor wheel 3 is replaced by a linear (e.g. chain) conveyor or a system of conveyors comprising one or more wheels and one or more linear conveyors.

Feed assembly 16 comprises two suction belt conveyors 17, each for feeding sheets of packing material 7 to conveyor wheel 3; and a suction belt conveyor 18 for feeding sheets of packing material 11 to conveyor wheel 3. Preferably, feed assembly 16 comprises three feed units of the type described in U.S. Pat. No. 5,406,775, to which full reference is made herein for the sake of clarity.

Machine 1 also comprises a conveyor system 19 for feeding articles 2 to conveyor wheel 3 at input station 4; a conveyor system 20 for receiving groups 10 from conveyor wheel 3 at output station 5; and a feed unit 21 comprising a pusher 22, and for inserting groups 10 inside seats 14.

Folding device 6 comprises folding members (not shown) for folding sheets of packing material 7 and 11 about articles 2 and groups 10 respectively; and stabilizing members (not shown), e.g. sealing devices, for stabilizing wrappings 8 and 12. In the embodiment shown, folding device 6 is located at a folding station 23 along paths P1 and P3, and folds sheets of packing material 7 and 11 and stabilizes wrappings 8 and 12 as articles 2 and groups 10 are fed, in use, through folding station 23.

In alternative embodiments, folding device 6 comprises folding members and/or sealing devices located at each seat 13, 14.

By way of example, in some variations not shown, folding device 6 is at least partly of the type described and/or illustrated in one of the following documents: U.S. Pat. No. 4,887,408, EP-A1-936143, EP-A1-1454829, GB1574951, WO-A1-00/47474, U.S. Pat. No. 6,708,466, EP-A1-940339, U.S. Pat. No. 5,003,755, to which full reference is made herein for the sake of clarity.

In particular embodiments, mainly for reasons of size, the folding members for folding sheets of packing material 7 differ from those for folding sheets of packing material 11; and, similarly, the stabilizing devices for stabilizing wrappings 8 differ from those for stabilizing wrappings 12.

Operation of machine 1 will now be described with reference to one operating cycle, and as of the instant in which two articles 2 have each been inserted inside a respective seat 13.

At this point, as the two articles 2 are fed along path P1 to output station 5, a respective sheet of packing material 7 is folded about each article 2.

Once the respective wrappings 8 are formed, the two articles 2 are extracted from respective seats 13 in a manner not shown in FIG. 1 but obvious to a skilled technician, and are brought into contact with each other and fed along path P2 to input station 4 by conveying device 9 (which therefore also functions as a group-forming device).

At this point, group 10 is inserted into a respective seat 14 and fed along path P3 to output station 5, while a sheet of packing material 11 is folded about group 10. Once group 10, enclosed in respective wrapping 12, reaches output station 5, conveyor system 20 feeds group 10 to follow-up operating units (not shown).

In the embodiment shown, articles 2 are substantially square-section, hinged-lid packets of cigarettes, and sheets of packing material 7 are sheets of cellophane. Nevertheless, in alternative embodiments not shown, articles 2 may be different types of packets, such as triangular-section or conventional hinged-lid packets of cigarettes. The longitudinal edges may be non-square, rounded or bevelled edges, or (as in the packet of cigarettes described in Patent Application EP-A1-0764595, to which full reference is made herein for the sake of clarity) the major transverse edges may be non-square, rounded or bevelled edges; or some longitudinal edges and some transverse edges may be non-square edges, so as to have both non-square, rounded or bevelled longitudinal and transverse edges. More specifically, articles 2 may be packets as described in WO-A1-2005/007537 and WO-A1-03/080473, to which full reference is made herein for the sake of clarity.

In different embodiments not shown, articles 2 may resemble the packet of cigarettes described in Patent Application EP-A1-1066206 (to which full reference is made herein for the sake of clarity); in which case, the front and rear walls are outwardly convex, and each have a flat central portion and two curved creased lateral bands.

In further embodiments not shown, machine 1 produces cartons of packets; in which case, sheets of packing material 7 are sheets of cellophane, and sheets of packing material 11 are sheets of cardboard.

In further embodiments not shown, articles 2 are products other than packets. For example, articles 2 may be groups of cigarettes; in which case, sheets of packing material 7 may be cardboard blanks, or sheets of paper for forming packages 8 of "soft" packets.

Moreover, the teachings of the present invention may be applied to the packaging of articles 2 of other than the tobacco industry, such as food, confectionary or toiletries.

As will be clear from the foregoing description and accompanying drawings, machine 1, by comprising a relatively small number of component parts, is much cheaper and more compact than known machines.

The invention claimed is:

1. A method of packing articles, comprising a first feed step to feed at least two articles (2) singly and successively along a first path (P1) from an input station (4) to an output station (5); a first folding step, performed during the first feed step, to fold a respective sheet of packing material (7) about each article (2) to form a respective first wrapping (8) about each article (2); a group-forming step to bring the articles (2) into contact with each other to form a group (10) of articles (2); a second feed step to feed the group (10) of articles (2) along a second path (P3), which at least partly coincides with the first path (P1); a second folding step, performed during the second feed step, to fold a further sheet of packing material (11) about the group (10) of articles (2) to form a second wrapping (12) about the group (10) of articles (2); and a third feed step, which substantially follows the first feed step and substantially precedes the second feed step, and during which the articles (2) are fed along a third path (P2) from the output station (5) to the input station (4).

2. A method as claimed in claim 1, wherein the first and second path (P1, P3) are each substantially in the form of a respective arc.

3. A machine for packing articles, comprising a first conveying device (3) for feeding at least two articles (2) singly and successively along a first path (P1) from an input station (4) to an output station (5); a folding device (6) for folding a respective sheet of packing material (7) about each article (2) to form a respective first wrapping (8) about each article (2); and a group-forming device (9) for bringing the articles (2) into contact with each other to form a group (10) of articles (2); the first conveying device (3) conveying the group (10) of articles (2) along a second path (P3) at least partly coinciding with the first path (P1); the folding device (6) folding a further sheet of packing material (11) about the group (10) of articles (2) to form a second wrapping (12) about the group (10); wherein the first conveying device (3) comprises at least two first seats (13), each for housing a respective article (2); and at least one second seat (14) for housing the group (10) of articles (2).

4. A machine as claimed in claim 3, further comprising a second conveying device for conveying the articles (2), enclosed in the respective first wrappings (8), along a third path (P2) from the output station (5) to the input station (4).

5. A machine as claimed in claim 1, wherein the ratio between the number of first seats (13) and the number of second seats (14) substantially equals the number of articles (2) in said group (10) of articles (2).

6. A machine as claimed in claim 1, wherein the first conveying device (3) comprises a conveyor wheel (3) comprising the first seats (13) and the second seat (14).

7. A machine as claimed in claim 1, wherein the two first seats (13) are arranged side by side.

8. A machine as claimed in claim 1, wherein the side by side first seats (13) are equal in number to the articles (2) constituting a group (10) of articles (2) and housed inside the second seat (14).

9. A machine as claimed in claim 1, and comprising a number of first feed devices (17), each for feeding a respective sheet of packing material (7) to the folding device (6); the first feed devices (17) being equal in number to the articles (2) constituting a group (10) of articles (2) and housed inside the second seat (14).

10. A machine as claimed in claim 9, further comprising at least one further feed device (18) for feeding the further sheet of packing material (11) to the folding device (6).

11. A machine as claimed in claim 1, wherein the folding device (6) comprises stabilizing means for stabilizing the first wrappings (8) about the respective articles (2), and for stabilizing the second wrapping (12) about the group (10) of articles (2).

12. A machine as claimed in claim 1, wherein the folding device (6) comprises first folding means for folding the sheets of packing material (7) about the respective articles (2); and second folding means for folding the further sheet of packing material (11) about the group (10) of articles (2).

* * * * *